US008103023B2

(12) United States Patent
Merks

(10) Patent No.: US 8,103,023 B2
(45) Date of Patent: Jan. 24, 2012

(54) APPARATUS AND METHOD FOR ACOUSTIC BEAMFORMING

(75) Inventor: Ivo Leon Diane Marie Merks, Eden Prairie, MN (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 1054 days.

(21) Appl. No.: 11/994,456

(22) PCT Filed: Jul. 3, 2006

(86) PCT No.: PCT/IB2006/052225

§ 371 (c)(1),
(2), (4) Date: Jan. 2, 2008

(87) PCT Pub. No.: WO2007/004188

PCT Pub. Date: Jan. 11, 2007

(65) Prior Publication Data

US 2008/0192955 A1 Aug. 14, 2008

(30) Foreign Application Priority Data

Jul. 6, 2005 (EP) ..... 05106124

(51) Int. Cl.
*H04R 25/00* (2006.01)

(52) U.S. Cl. ..... 381/150; 381/337; 381/92; 381/94.1; 381/55

(58) Field of Classification Search ..... 381/150, 381/337, 92, 94.1, 55
See application file for complete search history.

(56) References Cited

U.S. PATENT DOCUMENTS

2005/0031141 A1 * 2/2005 McCrackin et al. ..... 381/104
2006/0159283 A1 * 7/2006 Mathew et al. ..... 381/98

FOREIGN PATENT DOCUMENTS

| | | | |
|---|---|---|---|
| EP | 0700156 | A2 | 3/1996 |
| EP | 0901267 | A2 | 10/1999 |
| EP | 1116961 | A2 | 7/2001 |
| EP | 0954850 | B1 | 3/2004 |
| EP | 1475997 | A2 | 1/2008 |
| WO | W003058607 | A2 | 7/2003 |

* cited by examiner

*Primary Examiner* — Theresa T Doan

(57) ABSTRACT

An apparatus for acoustic beamforming comprises a beamform processor (105) for generating a beamformed signal from two audio inputs. An update processor (107) updates the beamforming filter of the beamform processor (105) if an update criterion is met. An adaptive filter (111) filters the signal from one of the signals and the difference signal between the filtered signal and the signal from the other audio input (101) is generated. An adaptation processor (115) adapts the adaptive filter (111) to minimize the difference signal. A criterion processor (109) modifies the update criterion in response to the (possibly normalized) difference signal. Specifically, the update criterion may be relaxed to improve acquisition performance if the difference signal is indicative of a strong signal outside the beam of the beamform processor (105).

14 Claims, 4 Drawing Sheets

APPARATUS AND METHOD FOR ACOUSTIC BEAMFORMING

The invention relates to an apparatus and method for acoustic beamforming and in particular, but not exclusively, to beamforming for speech sources.

Conversion of audio into electrical signals is an important process which today is used in many applications and for many different purposes. For example, the conversion of audio signals into sampled and digitized signals has become the basis for a large number of communication services and applications. E.g. voice communication supported by communication systems such as fixed traditional telephone systems, cellular communication systems or packet based networks (e.g. the Internet) has become an essential part of the communication service provision in most countries.

In order to achieve a high quality of the communication service, it is essential that a conversion of the desired signal with a high signal to noise ratio is achieved. However, increasingly communication terminals are used in difficult environments and under challenging conditions. For example, the increasing popularity of mobile communications has resulted in a large increase of phone conversations taking place in noisy and quickly changing environments. As a typical example, mobile voice calls may frequently be made using handsfree operation in a car environment.

It is clear that in such environments the generation of a high quality converted signal for the wanted speech signal rather than the background noise is a challenging task. An approach that has been proposed is to use a plurality of microphones and to process the plurality of signals to generate an acoustic beamforming towards the desired audio source. Such beamforming may effectively increase the desired signal to noise ratio as the desired signal may be amplified while background noise from other sources and directions may be reduced.

Various methods and algorithms have been proposed for acoustic beamforming. However, a problem facing these algorithms is how to provide accurate tracking of an audio source while ensuring that only the desired audio source is tracked.

Specifically, as an audio source may move relative to the microphones, the acoustic beamforming algorithm must follow such movements to ensure optimal performance. However, as there may be interfering noise sources it is important that the adaptation of the beamforming filter follows only the desired audio source and it is desirable to reduce the risk of the beamforming algorithm latching on to a strong noise source. This problem is even more challenging for non-continuous audio sources, such as human speech, as the beamforming algorithm must follow the desired speech sources rather than the interfering sources even when the desired speech source is silent.

One approach to this problem is to restrict updates to small, slow variations and discarding large, sudden variations. Specifically, the beamforming algorithm may comprise a criterion that allows the beamforming characteristics to be updated only if a significant in-beam signal is present. Thus, updating may be prevented if no in-beam signals are present as it is assumed that any audio sources outside the beam are noise sources. However, such an approach has a number of disadvantages and specifically restricts the ability of the beamforming algorithm to track large or sudden movements of the desired audio source and/or to lock on to a new audio source. Furthermore, the design of a robust detector for reliably detecting in-beam audio is difficult and tends to be a major obstruction for the practical application of adaptive acoustic beamformers.

Hence, an improved system for acoustic beamforming would be advantageous and in particular a system allowing an improved trade off between acquisition and tracking performance, improved accuracy of the beamforming, improved adaptation to large and/or sudden variations for the desired audio source, improved acquisition performance, improved in-beam detection, facilitated implementation, improved tracking performance and/or improved performance of the beamforming would be advantageous.

Accordingly, the Invention seeks to preferably mitigate, alleviate or eliminate one or more of the above mentioned disadvantages singly or in any combination.

According to a first aspect of the invention there is provided an apparatus for acoustic beamforming, the apparatus comprising: means for generating a first input signal from a first audio input; means for generating a second input signal from a second audio input; beamforming means comprising a beamforming filter for filtering the first and second input signal to generate a combined beamformed signal; update means for updating the beamforming filter if an update criterion is met; an adaptive filter for filtering the first input signal to generate a first filtered signal; means for generating a difference signal for the second input signal and the first filtered signal; means for adapting the adaptive filter to minimize the difference signal; and modifying means for modifying the update criterion in response to the normalized difference signal.

The invention may allow an improved acoustic beamforming. In particular, the invention may allow an improved adaptation to a new audio source and/or to an audio source having substantially and/or suddenly changed location. The invention may allow a beamforming algorithm where efficient tracking and acquisition performance can be achieved. An efficient and/or low complexity implementation may be achieved.

The combined beamformed signal may specifically correspond to a speech signal. The beamforming means may comprise a first adaptive filter for filtering the first input signal, a second adaptive filter for filtering the second input signal and combining means for generating the combined beamformed signal by combining (e.g. summing) the resulting filtered signals. The difference signal may possibly be a normalized difference signal.

According to an optional feature of the invention, the beamforming means is arranged to generate a noise reference signal for at least one of the first input signal and the second input signal relative to the combined beamformed signal.

This may allow improved performance and additional information for controlling the operation of the apparatus. The noise reference signal may for example be generated by subtracting a component corresponding to the desired signal from the first and/or second input signal. For example, the noise reference signal may be an indication of a difference between the first input signal and/or the second input signal and a signal corresponding to a time-inverse filtered combined beamformed signal wherein the time-inverse filtering corresponds to the filtering of the beamforming means.

According to an optional feature of the invention, the update criterion comprises a criterion that a power measure of the beamformed signal is higher than a threshold determined in response to the noise reference signal.

This may allow an efficient and practical control of the updating of the beamformed signal and provides an update criterion which may effectively and practically be varied by the modifying means.

According to an optional feature of the invention, the modifying means is arranged to modify the threshold in response to the difference signal.

This may allow an efficient and practical control of the updating to the beamformed signal and provides an update criterion which may effectively and practically be varied by the modifying means. The modifying means may specifically modify the threshold to relax the update criterion when the amplitude of the difference signal reduces. For example, the threshold may be reduced if the difference signal is below a given value.

According to an optional feature of the invention, the update criterion comprises a criterion that a power measure of the first input signal is higher than a threshold determined in response to the second input signal.

This may improve the beamforming operation and may in particular allow an improved adaptation performance.

According to an optional feature of the invention, the modifying means is arranged to modify the threshold in response to the difference signal.

This may allow an efficient and practical control of the updating to the beamformed signal and provides an update criterion which may effectively and practically be varied by the modifying means. The modifying means may specifically reduce the threshold for reducing amplitude of the difference signals. For example, the threshold may be reduced if the difference signal is below a given value.

According to an optional feature of the invention, the modifying means is arranged to relax the update criterion if the difference signal is below a threshold.

This may allow improved performance of the beamforming apparatus and may allow improved acquisition of new or significantly moved audio sources. The update criterion is relaxed by allowing a larger number of parameter combinations to update the beamforming means.

According to an optional feature of the invention, the threshold is determined in response to a noise reference signal for at least one of the first input signal and the second input signal relative to the combined beamformed signal.

This may allow improved performance of the beamforming apparatus and may specifically allow improved and dynamically varying trade off between acquisition and tracking performance.

According to an optional feature of the invention, the threshold is determined in response to the first input signal.

This may allow improved performance of the beamforming apparatus and may specifically allow improved and dynamically varying trade off between acquisition and tracking performance.

According to an optional feature of the invention, the apparatus further comprises means for determining a reliability indication of the combined beamformed signal and the means for modifying is arranged to modify the update criterion in response to the reliability indication.

This may allow improved and more flexible operation. For example, the apparatus may be operable to operate in a tracking mode and an acquisition mode and may comprise means for switching between these modes in response to the reliability indication. The modifying means may be arranged to modify the update criterion in the acquisition mode but not in the tracking mode. The reliability indication may indicate the likelihood of the beamforming generating an acoustic beam comprising the desired audio source.

According to an optional feature of the invention, the modifying means is arranged to only modify the update criterion if the reliability indication is below a threshold.

This may allow improved performance of the beamforming apparatus and may specifically allow improved and dynamically varying trade off between acquisition and tracking performance.

According to a second aspect of the invention, there is provided a communication unit for a communication system comprising: means for generating a first input signal from a first audio input; means for generating a second input signal from a second audio input; beamforming means comprising a beamforming filter for filtering the first and second input signal to generate a combined beamformed signal; update means for updating the beamforming filter if an update criterion is met; an adaptive filter for filtering the first input signal to generate a first filtered signal; means for generating a difference signal for the second input signal and the first filtered signal; means for adapting the adaptive filter to minimize the difference signal; and modifying means for modifying the update criterion in response to the difference signal.

According to a third aspect of the invention, there is provided method of acoustic beamforming, the method comprising: generating a first input signal from a first audio input; generating a second input signal from a second audio input; a beamforming filter filtering the first and second input signal to generate a combined beamformed signal; updating the beamforming filter if an update criterion is met; an adaptive filter filtering the first input signal to generate a first filtered signal; generating a difference signal for the second input signal and the first filtered signal; adapting the adaptive filter to minimize the difference signal; and modifying the update criterion in response to the difference signal.

These and other aspects, features and advantages of the invention will be apparent from and elucidated with reference to the embodiment(s) described hereinafter.

Embodiments of the invention will be described, by way of example only, with reference to the drawings, in which FIG. 1 illustrates an acoustic beamforming apparatus in accordance with some embodiments of the invention;

The following description focuses on embodiments of the invention applicable to speech signals for a communication unit for a cellular communication system (such as a mobile phone for a Global System for Mobile communications (GSM) system). However, it will be appreciated that the invention is not limited to this application but may be applied to many other devices and apparatuses including for example handsfree headsets.

Figure 1:
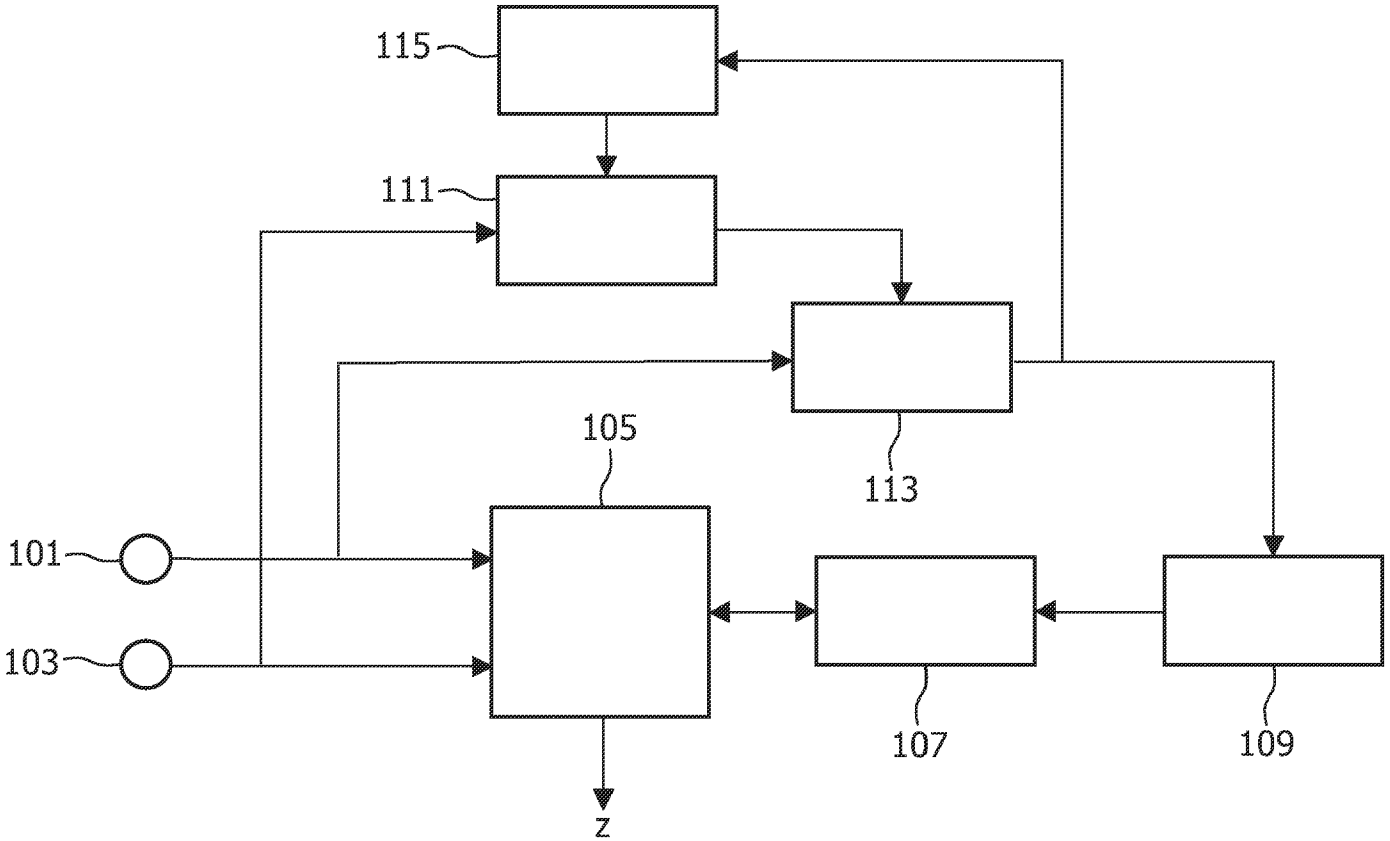

FIG. 1 illustrates an acoustic beamforming apparatus in accordance with some embodiments of the invention.

The apparatus comprises a first and second input element 101, 103. In the specific example, each of the input elements 101, 103 comprises a microphone as well as functionality for sampling and digitizing the signal to generate a first and second signal in the form of bitstreams of digital values.

The first and second input elements are coupled to a beamform processor 105 which is arranged to generate a combined beamformed signal z. Specifically, the beamform processor 105 comprises a beamforming filter which filters the first and/or the second input signals and combines these to generate a combined signal corresponding to an acoustic beam directed towards a desired audio source.

The beamformed signal z may then be processed further as required for the individual application. For the specific example of a cellular communication unit, the beamformed signal z may be fed to a speech encoder for speech encoding and subsequent transmission over the air interface to a base station, or prior to feeding it to the speech encoder it may be processed by a spectral post-processor for further noise reduction As the desired audio source moves, the filtering of the beamform processor 105 is adapted so that the resulting acoustic beam follows the desired audio source. For this purpose, the beamforming apparatus comprises an update processor 107 which is coupled to the beamform processor 105.

The update processor 107 may use any suitable algorithm for updating the filtering of the beamform processor 105 and may specifically use standard adaptive filtering optimization techniques as are well known in the art e.g. from beamforming apparatuses or from similar applications such as echo-cancellation.

The update processor 107 is coupled to a criterion processor 109 which evaluates an update criterion. If the update criterion is met, the criterion processor 109 generates a control signal for the update processor 107 which indicates that the update processor 107 may update the beamform processor 105. However, if the update criterion is not met, the criterion processor 109 generates a control signal for the update processor 107 which indicates that the update processor 107 may not update the beamform processor 105.

The update criterion may typically be an evaluation of the likelihood that the current signal used for updating the beamform processor 105 is indeed the desired signal. Specifically, the update processor 107 may update the beamform processor 105 in response to the in-beam signal (i.e. assuming that the signal in the main beam is indeed the desired signal). Accordingly, the criterion processor 109 may evaluate a criterion which is indicative of whether the beamform processor 105 is currently tracking an active audio source.

The criterion processor 109 may effectively prevent the beamform processor 105 to be updated to an undesired (potentially strong) speech source which is outside the acoustic beam. It may thus provide increased reliability and reduce the probability of the beam being erroneously directed to an undesired speech source, for example during a pause in the audio from the main source. However, this approach may also reduce the ability of the beamforming apparatus to form a new beam to an audio source outside the main beam. Thus, not only may the beamforming apparatus have reduced acquisition performance for new audio sources but it may also loose an existing audio source if this suddenly moves outside of the acoustic beam.

The beamforming apparatus of FIG. 1 comprises functionality which may mitigate this problem.

The beamforming apparatus comprises an adaptive filter 111 which is coupled to the second input element 103. The adaptive filter 111 is furthermore coupled to a difference processor 113 which is furthermore coupled to the first input element 111. Thus, the difference processor 113 receives a signal for the first microphone as well as a filtered signal for the second input signal. The difference processor 113 may specifically generate the difference signal as the direct difference between these signals but it will be appreciated that in some embodiments, the input signals may be further processed (e.g. filtered) before a difference signal is determined.

The difference processor 113 is coupled to an adaptation processor 115 which is arranged to adapt the adaptive filter to minimize the difference signal. Thus, the adaptation processor 115 adjusts the adaptive filter 111 such that the difference between the filtered output and the input signal from the other microphone is minimized. In this way the adaptive filter may be adapted to compensate for differences in the acoustic channels from a dominant audio source to the two microphones. Indeed, in the idealized case and for a single audio source, the adaptive filter 111 may be adapted such that the difference signal is substantially zero. Furthermore, other audio sources and in particular noise and interference sources may result in an interference signal of increasing power.

Thus, the possibly normalized difference signal provides an indication of whether the microphones are currently picking up a signal from a strong audio source. Typically such a situation may occur if e.g. a speaker is situated close to the microphones. For example, if the beamforming apparatus is part of a mobile phone, the possibly normalized difference signal may be a good indication of whether a user is currently speaking into the microphone from a close distance or if the current audio is mainly background noise.

In the example of FIG. 1, the difference processor 113 is coupled to the criterion processor 109 and feeds the difference signal to the criterion processor 109. The criterion processor 109 is arranged to modify the update criterion in response to the difference signal.

Specifically, the criterion processor 109 may be arranged to relax the update criterion if the difference signal is very close to zero indicating that a strong, close audio source is present.

For example, during normal operation, the criterion processor 109 may ignore the difference signal and use a predetermined criterion for determining if the beamform processor 105 may be updated. However, if the current audio signal is lost, for example because a user quickly changes location relative to the apparatus (e.g. the user of a mobile phone may switch this from one ear to another), the criterion processor 109 may enter an acquisition mode wherein the update criterion is controlled in response to the difference signal.

If the difference signal is sufficiently low the criterion processor 109 may control the update processor 107 such that an update of the beamform processor 105 is performed whereas if the difference signal is not sufficiently low, the criterion processor 109 may prevent such an update.

Thus by modifying the update criterion in response to the difference signal rather than merely using a constant update criterion, an improved acquisition performance may be achieved while maintaining efficient tracking.

As a specific example, if the combined beamformed signal generated by the beamform processor 105 has been of low amplitude for a relatively long period of time, this may e.g. be because the speech source has been silent for that duration or because the speech source has moved relative to the microphones such that the speech source is currently outside the main beam.

In this case, the criterion processor 109 may prevent updating if the difference signal is sufficiently high thereby indicating that no dominant audio source is received at the microphones. As this situation is most likely if the speaker has simply remained silent for a long duration, this approach may allow the beam to remain in the same location thus allowing the signal to be effectively captured when the user starts to speak again.

However, if the difference signal is sufficiently high, thereby indicating that a dominant audio source is present but outside the main beam, the criterion processor 109 may allow updating of the beamform processor 105. As this situation is most likely if the speaker has moved relative to the microphones, this approach may allow the beam to be moved to the new location.

In the following a more detailed description of an exemplary embodiment using a specific beamforming algorithm will be described. In particular, embodiments will be described that use the beamforming algorithm known as the Noise Void algorithm.

Figure 2:
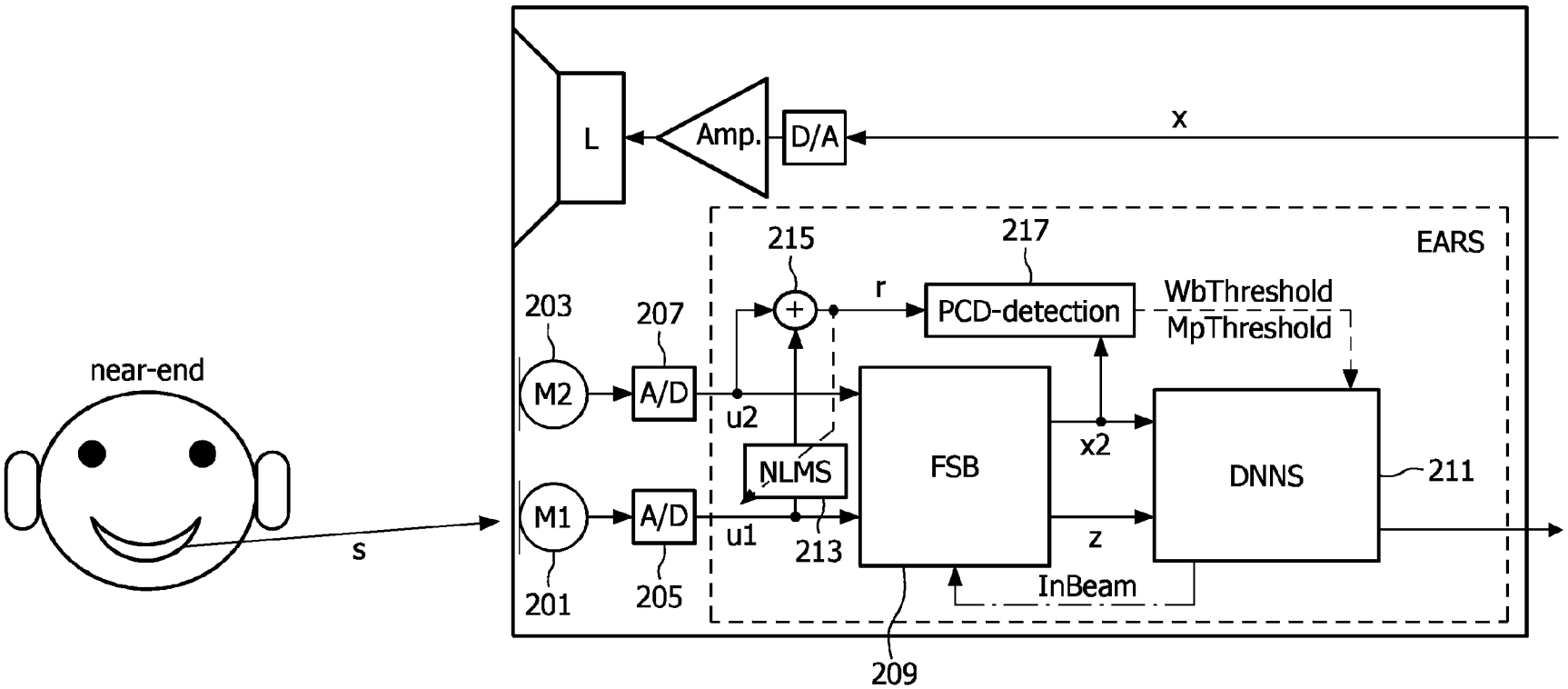
FIG. 2 illustrates an example of a mobile phone comprising means for acoustic beamforming in accordance with some embodiments of the invention.

FIG. 2 illustrates an example of a mobile phone comprising means for acoustic beamforming in accordance with some embodiments of the invention.

The mobile phone of FIG. 2 comprises two microphones 201, 203. The microphones 201, 203 are coupled to first and second analog to digital converters 205, 207 which sample and digitize the signals from the microphones 201, 203 to generate a first and second input signal u1, u2. The Noise Void algorithm is implemented by a beamformer 209 and a post-processor 211. The beamformer 209 is the Filtered-Sum Beamformer (FSB) as described in e.g. European Patent no: EP0954850-B: "Audio Processing arrangement with multiple sources". The post-processor 211 is the Dynamic Non-stationary Noise Suppressor (DNNS) as described in Patent Cooperation Treaty patent application no. WO0358607: "Audio Enhancement system having a spectral power dependent processor".

More specifically, the FSB 209 filters the microphone signals u1 and u2 with filters f1 and f2 and these filtered signals are summed into the FSB-output z.

In the frequency domain, the output of the FSB $z(\omega_k,l)$ is given by:

$$z(\omega_k,l)=F_1(\omega_k,l)u_1(\omega_k,l)+F_2(\omega_k,l)u_2(\omega_k,l).$$

where $F_1$ and $F_2$ are the beamform filter's frequency response and l denotes an FFT block.

The filters are updated such that the output $z(\omega_k,l)$ is maximized while the weights of the filters are constrained such that $$F_1(\omega_k,l)F_1^*(\omega_k,l)+F_2(\omega_k,l)F_2^*(\omega_k,l)=1 \quad \forall k=\{1,\ldots,M\}.$$

The filters may specifically be updated as is well known for adaptive filters in the field of filtering acoustic signals.

In addition to the beamformed signal, the FSB 209 also produces two reference signals, which are the complement of the beamformed signal. Specifically, the references seek to minimize the desired speech and may thus be considered noise reference signals as they are indicative of the presence of other audio signal components than the desired audio source picked up by the microphones 201, 203.

The reference signals may be calculated as $$x_1(\omega_k,l)=u_1(\omega_k,l)\Delta_N(\omega_k)-F_1^*(\omega_k,l)z(\omega_k,l)$$

and $$x_2(\omega_k,l)=u_2(\omega_k,l)\Delta_N(\omega_k)-F_2^*(\omega_k,l)z(\omega_k,l)$$

where $\Delta_N(\omega_k)$ is a delay of N samples to compensate for the delay in the filters. In the specific example only the second noise reference signal is used. This signal may be expressed as:

$$x_2(\omega_k,l)=u_2(\omega_k,l)\Delta_N(\omega_k)-F_2^*(\omega_k,l)(F_1(\omega_k,l)u_1(\omega_k,l)+F_2(\omega_k,l)u_2(\omega_k,l)).$$

which can be rewritten as:

$$\begin{aligned}x_2(\omega_k,l)&=(\Delta_N(\omega_k)-F_2(\omega_k,l)F_2^*(\omega_k,l))u_2(\omega_k,l)-F_2^*(\omega_k,l)F_1(\omega_k,l)u_1(\omega_k,l)\\&=(\Delta_N(\omega_k)-F_2(\omega_k,l)F_2^*(\omega_k,l))\left(u_2(\omega_k,l)-\frac{F_2^*(\omega_k,l)F_1(\omega_k,l)}{\Delta_N(\omega_k)-F_2(\omega_k,l)F_2^*(\omega_k,l)}u_1(\omega_k,l)\right).\end{aligned}$$

It will be appreciated that the noise reference signals $x_1$ and $x_2$ are indicative of the magnitude of audio sources picked up by relatively the first and the second microphone 201, 203 which is not from the desired source.

For example, assuming that only a single desired audio source exists and is represented by the microphone signals $u_1$ and $u_2$. In this case, $u_1$ and $u_2$ originate from the same single source but may have experienced different acoustic channels from the single source to the microphones 201, 203. The operation and beamforming operates such that the filters $f_1$ and $f_2$ compensate for these different acoustic channels such that a combined signal z directly corresponding to the signal from the audio signal is received.

By filtering the combined signal z with the time inverse filter $F_1^*$ of the filter $f_1$, a signal is generated which in this ideal case is substantially identical to that generated by the first microphone 201. In other words, $f_1$ is adapted to have the time-inverse filter response of the acoustic channel from the audio source to the first microphone 201 and thus the time-inverse filter of $f_1$ inherently corresponds to the transfer function of the acoustic channel from the audio source to the first microphone 201. As z corresponds to the original audio signal from the audio source, the output of the time-inverse filter $F_1^*$ will in the ideal case be identical to $u_1$ and $x_1$ will be zero.

However, for other audio sources, the time-inverse filter $F_1^*$ will not correspond to the acoustic channel they experience and they will accordingly contribute signal components to $x_1$. Furthermore, in practice $f_1$ will not exactly match the acoustic channel response, either due to channel estimation inaccuracies (non ideal adaptation of the filter) or due to implementation inaccuracies, and this deviation will also introduce signal components to the reference signal $x_1$.

The above principles apply equally to $x_2$ and it will thus be appreciated that $x_1$ and $x_2$ are noise reference signals which are indicative of the noise present in the combined beamformed signal z.

In a system as described, it is desirable to only update the filters when the received acoustic signal is mainly the speech from the desired source. This improves tracking performance and reduces the risk of false locks by the formation of new beams to undesirable audio sources. Accordingly, a detector that can detect the presence of wanted speech is desired for the described mobile phone. Unfortunately, the design of a robust detector is not easy and this is a major obstruction for the application of adaptive beamformers in practical products.

In the example, the mobile phone comprises functionality for limiting the updating of the FSB 209 to when the desired speaker is speaking. This detection of the desired speaker is also called in-beam detection and it detects whether the desired speaker is in the (main) beam of the beamformer. Thus, the post-processor 211 may evaluate an update criterion and the FSB 209 is only updated when this criterion is met.

In the specific example, the in-beam detection is done in the post-processor 211 by the output z of the FSB 209 being compared with the reference signal x2. Specifically, the update criterion comprises a criterion that a power measure of the beamformed signal is higher than a threshold determined in response to the noise reference signal. In more detail, the post-processor 211 requires that $P_z > W_{bThreshold} P_{x2}$, where $P_z$ is the power in the combined beamformed signal z, $P_{x2}$ is the power of the noise reference signal $x_2$ and $W_{bthreshold}$ is a fixed parameter. $W_{bthreshold}$ depends on the specific application and required performance but values may typically be set between two and three.

In addition, the update criterion comprises a criterion that a power measure of the first input signal is higher than a threshold determined in response to the second input signal. This evaluation may correspond to a direct consideration of the power of signals picked up by the microphones 201, 203.

For example, for a handset application or a headset application, it can typically be assumed that the first microphone is much closer to the mouth of the desired speaker than the second microphone. When the desired speaker is speaking, the power of the signal of the first microphone is therefore larger than the power of the signal of the second microphone. Therefore an additional consideration includes the microphone powers and especially it is required that $P_{u1} > M_{pThreshold} P_{u2}$ for an in-beam detection where $P_{u1}$ is the power of the signal of the first microphone 201, $P_{u2}$ is the power of the signal of the second microphone 203 and $M_{bthreshold}$ is a fixed parameter. The preferred value of $M_{bthreshold}$ depends on the specific application and required performance but values may typically be set between two and ten.

The update criterion may of course depend on the specific application. E.g. for a handset or headset application both requirements must be met before the FSB 209 may be updated. However, for a hands-free application it may be sufficient that the in-beam detection requirement is met.

However, although the restriction of the updating of the FSB 209 to situations wherein the detector indicates that the desired audio source is in the main beam provides improved tracking performance and reduces the change of false locks, it also has a number of disadvantages as previously described. Specifically, if the desired speaker is in a different position than the beamformer expects him/her too be, the beamformer may never adapt. At start-up, for example, the beamformer is initialized with filters that correspond to a beam being formed in the direction of the expected position of the desired speaker. However, if the desired speaker is in another position, the beamformer may never adapt to this position. Also, if the desired speaker e.g. moves the phone during a phone call (and thereby changes his position with respect to the mobile phone), the in-beam detector and/or power detector will not detect that the speech source is indeed the desired speech source and thus the FBS 209 will not be updated and will not adapt to this new position.

In the example of FIG. 2, these disadvantages are addressed by the inclusion of additional functionality. Specifically, the mobile phone comprises an adaptive filter 213 which is coupled to a subtractor 215 and to the first analog to digital converters 205. The subtractor 215 is further coupled to the second analog to digital converter 207.

Using a frequency domain notation, the output signal of the subtractor 215 thus generates a difference signal given by:

$$r(\omega_k,l)=u_2(\omega_k,l)-H(\omega_k,l)u_1(\omega_k,l)$$

where $H(\omega_k,l)$ represents the frequency domain transfer function of the adaptive filter 213.

The adaptive filter 213 is adapted to minimize the correlation between $u_1$ and $u_2$ and particular is adapted to minimize the difference signal r.

The difference signal may be considered to be a good indication of whether a close audio source is present. For example, in an ideal case with only a single audio source, the signals received at the microphones 201, 203 will only differ as a function of the difference between the acoustic channels between the audio source and the respective microphones 201, 203. This difference may be compensated by the adaptive filter 213 and a difference signal r substantially equal to zero may be derived. However, if no dominant audio source is present, the signals from the respective microphones cannot be cancelled out and a difference signal r of significant amplitude will result.

It may typically be assumed that a close speech source is indeed the desired speech source and the difference signal r may thus provide a separate indication of whether a desired speech source is present. Furthermore, this indication is independent of the tracking performance of the FSB 209 and is not subject to the update criterion as implemented by the post-processor 209.

Figure 3:
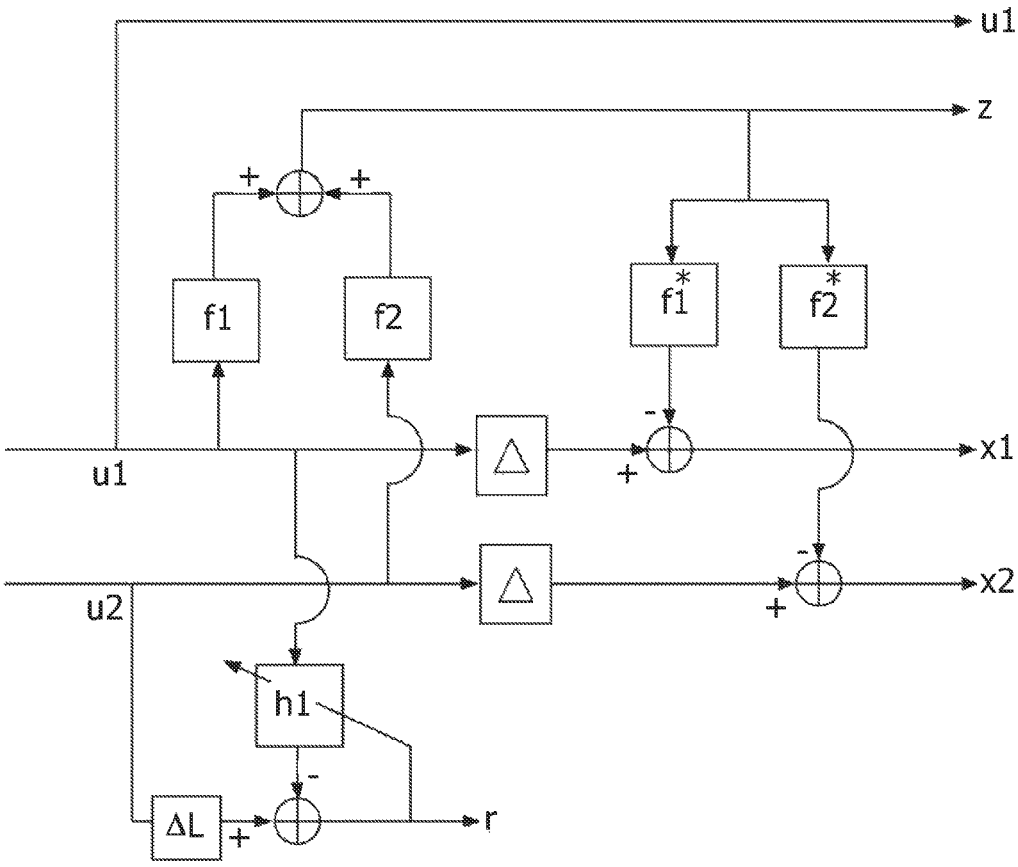
FIG. 3 illustrates a block diagram for an example of a topology for generating signals used in an acoustic beamforming apparatus in accordance with some embodiments of the invention.

FIG. 3 illustrates a block diagram for an example of a topology for generating the described signals.

In the system of FIG. 2 the subtractor 215 is coupled to a modifying processor 217 which receives the difference signal. The modifying processor 217 is arranged to determine the thresholds used by the detection algorithms of the post-processor 211. Specifically, the modifying processor 217 determines the values $W_{bthreshold}$ and $M_{bthreshold}$ which are used to determine the thresholds used to determine if the FSB 209 is to be updated.

In the example, the modifying processor 217 modifies the values $W_{bthreshold}$ and $M_{bthreshold}$ in response to the difference signal thus resulting in the thresholds for the in-beam detection and for the microphone power detection being modified.

The modifying processor 217 specifically considers the power of the difference signal $P_r$ relative to the power of the second noise reference signal $P_{x2}$. For example, the value $$P_{pcd} = \frac{P_r - P_{x_2}}{P_r}$$

may be determined.

It will be appreciated that in some embodiments, $P_r$ or $P_{x2}$ may be compensated before a comparison of these values. For example, comparing the equations for r and $x_2$ it can be send that $u_2(\omega_k,l)$ is multiplied by a factor $\Delta_N(\omega_k)-F_2(\omega_k,l)F_2^*(\omega_k,l)$. To correct for this factor, $P_r$ may be modified as:

$$P_r = P_r\left(1 - \sum_{k=0}^{k=M-1} F_2(\omega_k, l)F_2^*(\omega_k, l)\right)$$

Although this is not an accurate approximation, it has been found to provide desirable performance in practice.

It will be appreciated that $P_{pcd}$ is an indication of the relative noise levels of the adaptive filter cancellation and of the beamforming performance of the FSB 207. Thus, for low values of $P_{pcd}$, the adaptive filter is able to effectively cancel out the signals between the microphones 201, 203 whereas the FSB 209 is not able to do so. This is indicative of a strong audio signal being present but outside the acoustic beam of the FSB 209.

In the example of FIG. 2, the modifying processor 217 may in such a case relax the update criterion of the post-processor 211 thereby allowing an improved acquisition performance.

A relaxation of the criterion may be considered to be a modification of the criterion such that at least one parameter combination for the beamforming apparatus which would not have allowed updating before relaxation will now allow updating. Thus, in situations where the FSB 209 would not normally be updated because no signal is present within the beam, the update criterion may be relaxed if the independent indication of the difference signal indicates that a close audio source indeed is present. This may allow the FSB 209 to capture this audio source.

Another useful measure is the amount of cancellation in the adaptive filter. A suitable measure thereof is denoted $P_{pcdz}$ and is determined as $$P_{pcdz} = \frac{P_r}{P_{u1}}$$

It will be appreciated that the $P_{pcdz}$ may be considered a normalized measurement of the power of the difference signal and that the lower the value of $P_{pcdz}$ the better the cancellation and thus the stronger the indication of the presence of a closer audio source.

In the example, the modifying processor 217 evaluates both parameters. Specifically, if both $P_{pcd}$ and $P_{pcdz}$ are sufficiently small, the values $W_{bthreshold}$ and $W_{bthreshold}$ are reduced. If the values are sufficiently small, the in-beam and microphone power detector requirements will be met and the update criterion will thus be met resulting in the FSB 209 being updated and thus adapting to the strong audio source. After the FSB 209 is updated, the values of $W_{bthreshold}$ and $W_{bthreshold}$ may be increased again. When the FSB 209 has converged, the beam is aimed at the desired speaker and the update criterion is back to the nominal value such that the beamformer is not sensitive to other audio sources. Thus, a temporary variation in the trade off between tracking performance and acquisition performance may automatically be achieved.

As a specific example of the operation of the modifying processor 217 is given by the following program sequence (using C language):

```
if( Ppcd < PpcdThr) && ( Ppcdz < PpcdzThr )
{
   WbThreshold = MAX(WbThreshold – 0.1,    1);
   MpThreshold = MAX(MpThreshold – 0.1,    0.5);
}
else if( ( UpdateOnOff!=0 ) ||
      ( (Ppcd > 0) && ( Ppcdz< PpcdzThr ) ) )
{
   WbThreshold = MIN(WbThreshold +0.02, WbThresholdMax );
   MpThreshold = MIN(MpThreshold +0.02, MpThresholdMax );
}
```

It will be appreciated that the modification of the update criterion may be limited to situations in which the beamforming is considered to be unreliable. For example, the power of the noise reference signal $x_2$ relative to the power of the combined reference signal may be considered a reliability indication for the beamformed signal. The lower this value is, the more reliable the beamformed signal is.

In a simple embodiment, this reliability indication may be compared to a predetermined threshold. If the reliability indication is below the threshold, the beamformer may be considered to be in a tracking state where the desired source is effectively tracked, and the update criterion may therefore be kept at the nominal values.

However, if the reliability indication increases above the threshold (or a second threshold thereby introducing hysteresis in the detection), the beamformer may be considered to have lost the signal and may therefore be in an acquisition state wherein the update criterion may be relaxed to improve the changes of detecting a desired source.

Figure 4:
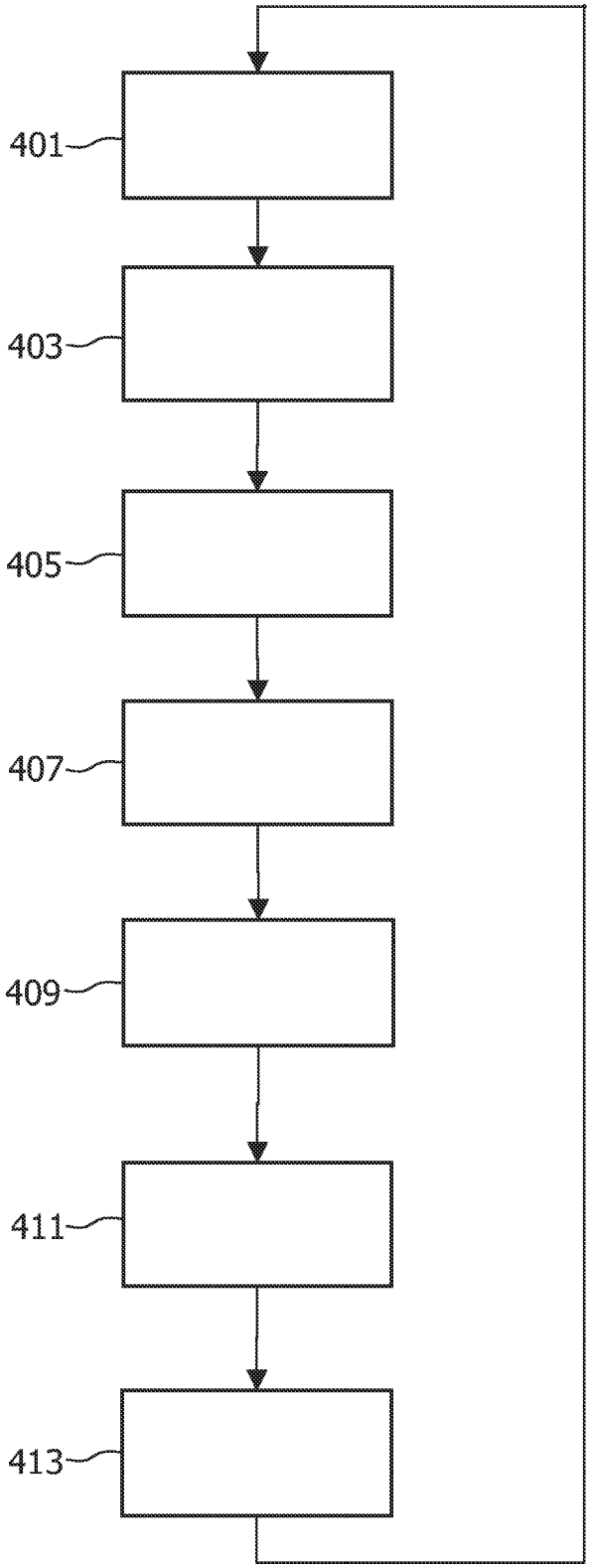
FIG. 4 illustrates a method of acoustic beamforming in accordance with some embodiments of the invention.

FIG. 4 illustrates a method of acoustic beamforming in accordance with some embodiments of the invention.

The method initiates in step 401 wherein a first input signal is generated from a first audio input and a second input signal is generated from a second audio input in a time interval.

Step 401 is followed by step 403 wherein a beamforming filter filters the first and second input signals to generate a combined beamformed signal.

Step 403 is followed by step 405 wherein an adaptive filter filters the first input signal to generate a first filtered signal.

Step 405 is followed by step 407 wherein a difference signal between the second input signal and the first filtered signal is generated.

Step 407 is followed by step 409 wherein the adaptive filter is adapted to minimize the difference signal.

Step 409 is followed by step 411 wherein the update criterion is modified in response to the difference signal.

Step 411 is followed by step 413 wherein an update criterion is evaluated and if the update criterion is met the beamforming filter is updated.

Following step 413, the method returns to step 401 for processing of the next time interval.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An apparatus for acoustic beamforming, the apparatus comprising means for generating (101) a first input signal from a first audio input;

means for generating (103) a second input signal from a second audio input;

beamforming means (105) comprising a beamforming filter for filtering the first and second input signal to generate a combined beamformed signal;

update means (107) for updating the beamforming filter if an update criterion is met;

an adaptive filter (111) for filtering the first input signal to generate a first filtered signal;

means for generating a difference signal (113) for the second input signal and the first filtered signal;

means for adapting (115) the adaptive filter to minimize the difference signal; and modifying means (109) for modifying the update criterion in response to the difference signal.

2. The apparatus of claim 1 wherein the beamforming means (105) is arranged to generate a noise reference signal for at least one of the first input signal and the second input signal relative to the combined beamformed signal.

3. The apparatus of claim 2 wherein the update criterion comprises a criterion that a power measure of the beamformed signal is higher than a threshold determined in response to the noise reference signal.

4. The apparatus of claim 3 wherein the modifying means (109) is arranged to modify the threshold in response to the difference signal.

5. The apparatus of claim 1 wherein the update criterion comprises a criterion that a power measure of the first input signal is higher than a threshold determined in response to the second input signal.

6. The apparatus of claim 5 wherein the modifying means (109) is arranged to modify the threshold in response to the difference signal.

7. The apparatus of claim 1 wherein the modifying means (109) is arranged to relax the update criterion if the difference signal is below a threshold.

8. The apparatus of claim 7 wherein the threshold is determined in response to a noise reference signal for at least one of the first input signal and the second input signal relative to the combined beamformed signal.

9. The apparatus of claim 7 wherein the threshold is determined in response to the first input signal.

10. The apparatus of claim 1 wherein the apparatus further comprises means for determining a reliability indication of the combined beamformed signal and the means for modifying (109) is arranged to modify the update criterion in response to the reliability indication.

11. The apparatus of claim 10 wherein the modifying means (109) is arranged to only modify the update criterion if the reliability indication is below a threshold.

12. A communication unit for a communication system comprising:

means for generating (201, 205) a first input signal from a first audio input;

means for generating (203, 307) a second input signal from a second audio input;

beamforming means (209) comprising a beamforming filter for filtering the first and second input signal to generate a combined beamformed signal;

update means (211) for updating the beamforming filter if an update criterion is met;

an adaptive filter (213) for filtering the first input signal to generate a first filtered signal;

means for generating (215) a difference signal for the second input signal and the first filtered signal;

means for adapting (213, 215) the adaptive filter (213) to minimize the difference signal; and modifying means (217) for modifying the update criterion in response to the difference signal.

13. A method of acoustic beamforming, the method comprising:

generating (401) a first input signal from a first audio input;

generating (401) a second input signal from a second audio input;

a beamforming filter filtering (403) the first and second input signal to generate a combined beamformed signal;

updating (405) the beamforming filter if an update criterion is met;

an adaptive filter filtering (407) the first input signal to generate a first filtered signal;

generating a difference signal (409) for the second input signal and the first filtered signal;

adapting (411) the adaptive filter to minimize the difference signal; and modifying (413) the update criterion in response to the difference signal.

14. A computer program product for executing the method of claim 13.

* * * * *